US006895708B2

(12) United States Patent
Kim et al.

(10) Patent No.: US 6,895,708 B2
(45) **Date of Patent: *May 24, 2005**

(54) ACCESSORY MOUNTS FOR FIREARMS

(75) Inventors: Paul Y. Kim, Irvine, CA (US); John W. Matthews, Newport Beach, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/764,185

(22) Filed: Jan. 22, 2004

(65) Prior Publication Data

US 2005/0000142 A1 Jan. 6, 2005

Related U.S. Application Data

(63) Continuation-in-part of application No. 10/447,874, filed on May 29, 2003, now Pat. No. 6,779,288.

(51) Int. Cl.[7] ..... F41C 23/00

(52) U.S. Cl. ..... 42/72; 42/124; 42/75.01; 42/90; 42/106

(58) Field of Search ..... 42/72, 124, 75.01, 42/90, 106

(56) References Cited

U.S. PATENT DOCUMENTS 2,128,936 A 9/1938 Green
2,287,066 A 6/1942 Rogers
2,965,994 A 12/1960 Sullivan
3,075,314 A 1/1963 Bakker
3,090,150 A 5/1963 Stoner
3,838,522 A 10/1974 Williams
3,857,323 A 12/1974 Ruger et al.
4,536,982 A 8/1985 Bredbury et al.
4,627,183 A 12/1986 Stuckman (Continued)

OTHER PUBLICATIONS

United States Department of Defense, Military Standard: Dimensioning of Accessory Mounting Rail for Small Arms Weapons, MIL–STD–1913, Feb. 3, 1995.

*Primary Examiner*—J. Woodrow Eldred
(74) *Attorney, Agent, or Firm*—David Weiss

(57) ABSTRACT

An accessory mount for a firearm having a longitudinal barrel, a first support and a second support forwardly of the first support. The accessory mount includes a first longitudinal mount housing having a rear portion, the first housing positionable along the barrel with its rear portion supported by the first support; a second longitudinal mount housing having a rear portion, the second housing positionable along the barrel with its rear portion supported by the second support; longitudinal grooves in one of the housings, and longitudinal flanges on the other of the housings slidably received by the channels and transversely securing the housings together; and at least one adjustable member carried by one of the housings and cooperating with the other of the housings for urging the housings in longitudinally opposite directions, preferably with the rear portion of the first housing rearwardly urged against the first support and with the rear portion of the second housing forwardly urged against the second support.

46 Claims, 7 Drawing Sheets

U.S. PATENT DOCUMENTS 4,663,875 A 5/1987 Tatro
4,733,489 A 3/1988 Kurak
4,742,636 A 5/1988 Swan
4,756,111 A * 7/1988 Lapier ..... 42/128
4,845,871 A 7/1989 Swan
4,941,277 A 7/1990 Lawlor
5,010,676 A 4/1991 Kennedy
5,052,141 A 10/1991 Sammons
5,092,071 A 3/1992 Moore
5,111,587 A 5/1992 Plank
5,142,806 A 9/1992 Swan
5,198,600 A 3/1993 E'Nama
5,201,135 A 4/1993 Cowles
5,343,650 A 9/1994 Swan
5,400,540 A 3/1995 Solinsky et al.
5,522,166 A 6/1996 Martel
5,533,292 A 7/1996 Swan
5,590,484 A 1/1997 Mooney et al.
5,634,288 A 6/1997 Martel
5,704,155 A 1/1998 Primeau, IV
5,758,448 A 6/1998 Thummel
5,826,363 A 10/1998 Olson
5,918,374 A 7/1999 Campbell et al.
5,937,562 A 8/1999 Brough
6,012,374 A 1/2000 Brandl et al.
6,345,464 B1 2/2002 Kim et al.
6,385,892 B1 5/2002 Vendetti
6,442,883 B1 9/2002 Waterman et al.
6,508,027 B1 1/2003 Kim
6,655,069 B2 * 12/2003 Kim ..... 42/114

* cited by examiner

ACCESSORY MOUNTS FOR FIREARMS

CROSS REFERENCE TO RELATED APPLICATION

This application is a continuation-in-part of U.S. patent application Ser. No. 10/447,874, filed May 29, 2003, issued Aug. 24, 2004 as U.S. Pat. No. 6,779,288, incorporated herein by reference.

BACKGROUND OF THE INVENTION

This invention relates to accessory mounts for firearms, and more particularly to accessory mounts that may be quickly, easily and firmly secured to a firearm, and quickly and easily removed therefrom.

Various types of devices are useful as accessories for being mounted to firearms, examples of such accessories being target illuminators, laser sights and vertical handgrips. Such accessories are conventionally mounted to an interface apparatus descriptively referred to as an accessory mount, which has been secured to the firearm. Such accessory mounts may include rail interface systems well known in the art pertaining to firearms, and in particular with respect to submachine guns, carbines, rifles and other firearms used for military and police operations.

The aforementioned parent application Ser. No. 10/447,874 discloses accessory mounts that may be firmly secured to a firearm along the firearm's barrel, and which may be quickly and easily secured to and removed from the firearm. According to one aspect of the invention disclosed therein, an accessory mount is provided for a firearm having a longitudinal barrel, a rear support and a front support, the accessory mount comprising the combination of: a first longitudinal mount housing having a rear end, the first housing positionable along the barrel with the rear end of the first housing supported by the rear support; a second longitudinal mount housing having a front end, the second housing positionable along the barrel with the front end of the second housing supported by the front support; longitudinal channels in one of the first and second housings, and longitudinal flanges on the other of the first and second housings slidably received by the channels and transversely securing the first and second housings together; and at least one adjustable member carried by one of the first and second housings and cooperating with the other of the first and second housings for urging the first and second housings in longitudinally opposite directions. In the preferred embodiment disclosed in the parent application, one of the housings is provided with inwardly directed longitudinally spaced-apart lugs, and the other housing is provided with a plurality of outwardly directed longitudinally spaced-apart flanges cooperating with the lugs for transversely securing the housings together when the second housing is placed to the first housing and the housings are longitudinally displaced relative to each other. The preferred embodiments of the invention taught in the parent application are exemplified therein as being secured to types of firearms such as M-4, M-16 and Sig Sauer automatic rifles.

SUMMARY OF THE INVENTION

The present invention also provides an accessory mount that may be firmly secured to a firearm along the firearm's barrel, and which may be quickly and easily secured to and removed from the firearm. According to one aspect of the present invention, there is provided an accessory mount for a firearm having a longitudinal barrel, a first support and a second support forwardly of the first support and preferably above the barrel, the accessory mount comprising the combination of: a first longitudinal mount housing having a rear portion, the first housing positionable along the barrel with the rear portion of the first housing supported by the first support; a second longitudinal mount housing having a rear portion, the second housing positionable along the barrel with the rear portion of the second housing supported by the second support; longitudinal grooves in one of the first and second housings, and longitudinal flanges on the other of the first and second housings slidably received by the channels and transversely securing the first and second housings together; and at least one adjustable member carried by one of the first and second housings and cooperating with the other of the first and second housings for urging the first and second housings in longitudinally opposite directions. At least one of the first and second housings includes a rail structure for mounting a firearm accessory thereto.

A preferred embodiment of the mount according to the present invention may accommodate a type of firearm including a transverse post or pin secured to the firearm above the barrel, such as a G36 carbine in which a transverse pin is removably secured to the firearm above the barrel. Such pin comprises the firearm's second support for the invention's preferred embodiment wherein the rear portion of the second housing includes at least one transverse opening or aperture for cooperating with the pin, or through which the pin may be received, for supporting the rear portion of the second housing.

The first housing includes a front portion and the second housing includes a front portion, and in the preferred embodiment the at least one adjustable member is carried by the front portion of the second housing for cooperating with the front portion of the first housing to rearwardly urge the rear portion of the first housing against the first support and to forwardly urge the rear portion of the second housing against the second support.

According to another aspect of the present invention, an accessory mount is provided for a firearm having a longitudinal barrel, a first support and a second support forwardly of the first support, the accessory mount comprising the combination of: a first longitudinal mount housing having a rear support, the first housing positionable along the barrel with the rear portion of the first housing supported by the first support; a second longitudinal mount housing having a front end, the second housing positionable along the barrel for being supported by the second support rearwardly of the second housing's front end; longitudinal grooves in one of the first and second housings, and longitudinal flanges on the other of the first and second housings slidably received by the channels and transversely securing the first and second housings together; and at least one adjustable member carried by one of the first and second housings for cooperating with the other of the first and second housings for urging the first and second housings in longitudinally opposite directions, preferably with the first housing's rear portion being urged rearwardly against the first support and with the second housing being urged forwardly against the second support.

According to a further aspect of the present invention, there is provided firearm and accessory mount apparatus comprising in combination: a firearm including a longitudinal barrel, a first support and a second support forwardly of the first support; a first longitudinal mount housing having a rear portion, the first housing positioned along the barrel with the rear portion of the first housing supported by the firearm's first support; a second longitudinal mount housing having a rear portion, the second housing positioned along the firearm's barrel with the rear portion of the second housing supported by the firearm's second support; longitudinal channels in one of the first and second housings, and longitudinal flanges on the other of the first and second housings slidably received by the channels and transversely securing the first and second housings together; and at least one adjustable member carried by one of the first and second housings and cooperating with the other of the first and second housings for urging the first and second housings in longitudinal opposite directions, the at least one adjustable member rearwardly urging the rear portion of the first housing against the first support and forwardly urging the rear portion of the second housing against the second support.

The present invention further provides a method of installing an accessory mount to a firearm, a preferred manner of practicing such method comprising the steps of: providing a firearm having a longitudinal barrel, a first support, and a second support forwardly of the first support and preferably situated above the barrel; providing a first longitudinal mount housing having a rear portion and a second longitudinal mount housing having a rear portion, one of the first and second housings including longitudinal channels and the other of the first and second housings including longitudinal flanges; placing the second housing to the first housing with the flanges slidably received by the channels; positioning the first and second housings along the barrel with the rear portion of the first housing supported by the first support and with the rear portion of the second housing supported by the second support; and urging the first and second housings in longitudinally opposite directions, preferably rearwardly urging the rear portion of the first housing against the first support and forwardly urging the rear portion of the second housing against the second support.

BRIEF DESCRIPTION OF THE DRAWINGS

The novel features believed to be characteristic of the present invention, together with further advantages thereof, will be better understood from the following description considered in connection with the accompanying drawings in which preferred embodiments of the invention of the parent application and of the present invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
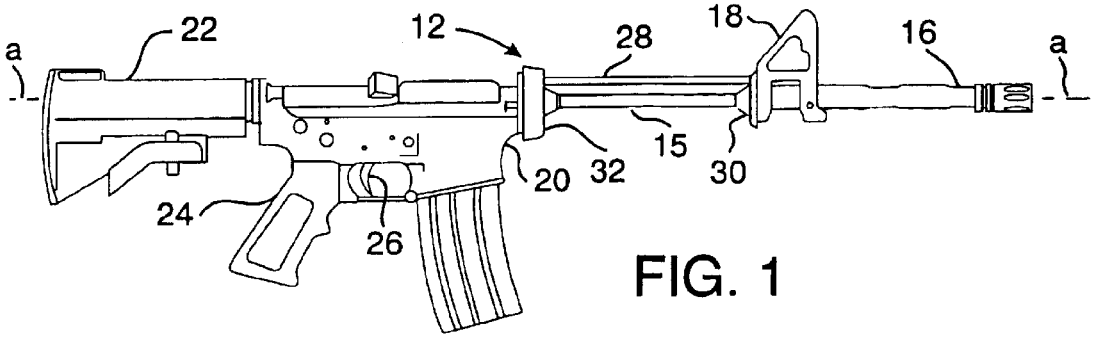
FIG. 1 is a side elevation view of an example of a firearm to which a preferred embodiment of an accessory mount may be secured, according to the aforementioned parent application Ser. No. 10/447,874.
Figure 2:
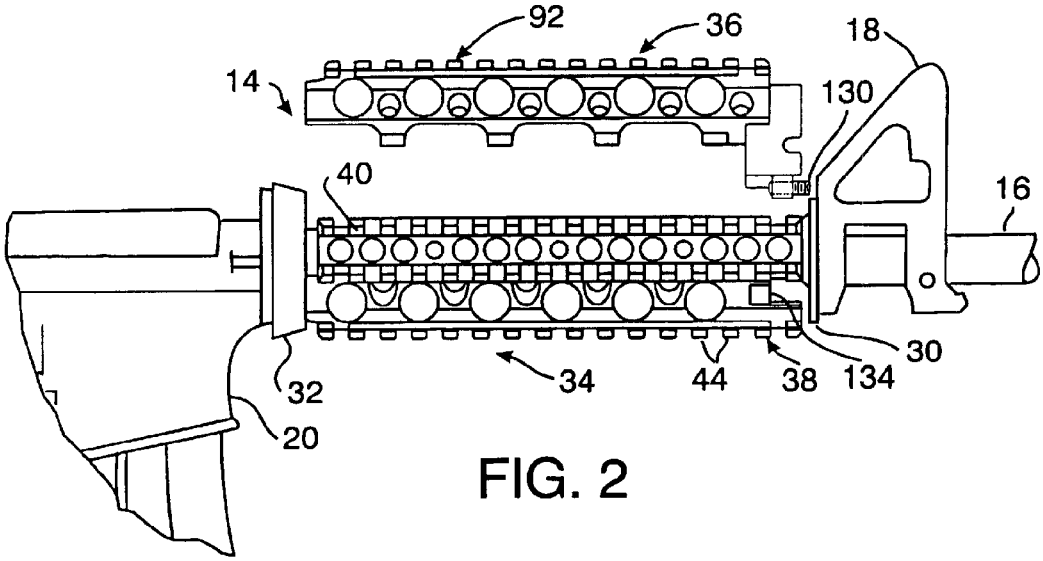
FIG. 2 is an enlarged fragment of the firearm of FIG. 1, showing a preferred accessory mount embodiment according to the aforementioned parent application Ser. No. 10/447,874 in process of being secured thereto.

FIGS. 1–16 of the drawings are illustrative of preferred embodiments of accessory mount apparatus and methods taught in the aforementioned parent application Ser. No. 10/447,874. As disclosed therein, FIGS. 1 and 2 illustrate an example of a firearm 12, such as an M-4 or M-16 automatic rifle, the M-4 rifle being shown in the example of FIG. 1, to which a preferred embodiment of an accessory mount 14 may be equipped in the manner illustrated in FIG. 2. The accessory mount 14 is secured to the firearm 12 and surrounds a section 15 of the firearm's barrel 16 along the firearm's fore-end section between the firearm's front sight 18 and receiver 20. The firearm 12 further includes a stock 22, pistol grip 24 and trigger 26. Such automatic rifles 12 are well known in the firearms art, and typically include a gas tube 28 above the barrel 16 and extending between the receiver 20 and the firearm's handguard forward support cup 30. M-4 and M-16 rifles typically include a handguard rear slip ring or support cup 32 at the receiver 20 with a barrel nut (not shown) at the rear end of the barrel 16.

As used herein, and in particular with respect to FIGS. 1–16, the word "front" or "forward" describes a direction toward the muzzle of the barrel 16 (i.e., to the right as shown in FIGS. 1 and 2); "rear" or "rearward" describes the direction opposite the front (i.e., to the left as shown in the drawing of FIGS. 1 and 2); "above" or "upper" means vertically above when the firearm 12 is in a firing position with its barrel 16 horizontal; "below" or "lower" means vertically below when the firearm 12 is in a firing position with its barrel 16 horizontal; "longitudinal" means the direction along or parallel to the longitudinal axis a of the barrel 16 or the longitudinal axes of the accessory mount 14 or mount housing 34, 36; and "transverse" means a direction perpendicular to a longitudinal direction.

Turning to FIGS. 2–15, the accessory mount 14 includes a generally semicylindrical first shell or housing 34 and a generally semicylindrical second shell or housing 36. The term "semicylindrical" is used herein in its broad sense as denoting a partial cylindrical configuration, i.e. the housing 34 or 36 may have a transverse cross-sectional configuration describing an arc greater than or less than 180°, as well as describing an arc of 180°. In the preferred embodiment, the transverse cross-sectional configuration of the first housing shown as a lower housing 34 describes an arc greater than 180°, while the transverse cross-sectional configuration of the second housing shown as an upper housing 36 describes an arc less than 180°.

The first or lower mount housing 34 extends along a longitudinal axis a', and includes at least one longitudinal rail structure therealong such as a bottom rail structure 38 along the exterior underside thereof, and which also may include side rail structures 40, 42, to which may be mounted one or more firearm accessories such as a target illuminator, a laser sight, a handgrip, and other devices.

Figure 3:
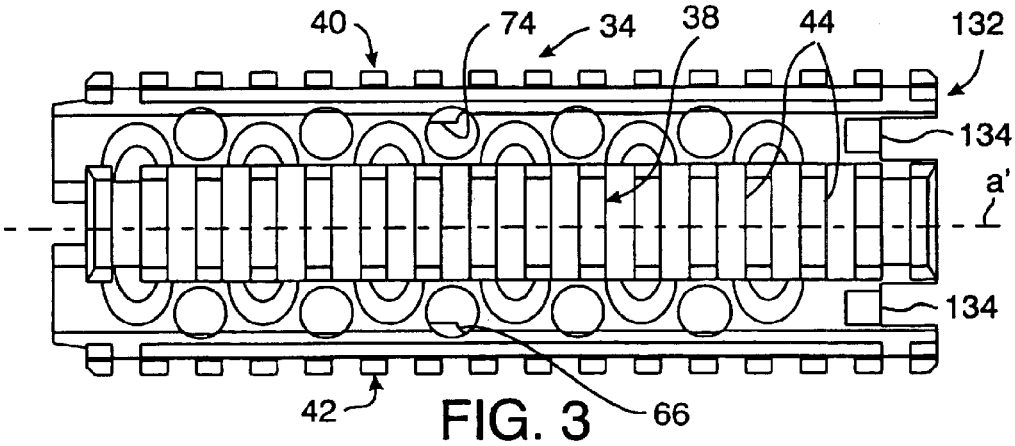
FIG. 3 is a bottom plan view of a preferred embodiment of a first or lower mount housing forming a part of the accessory mount preferred embodiment shown in FIG. 2, in increased scale.
Figure 4:
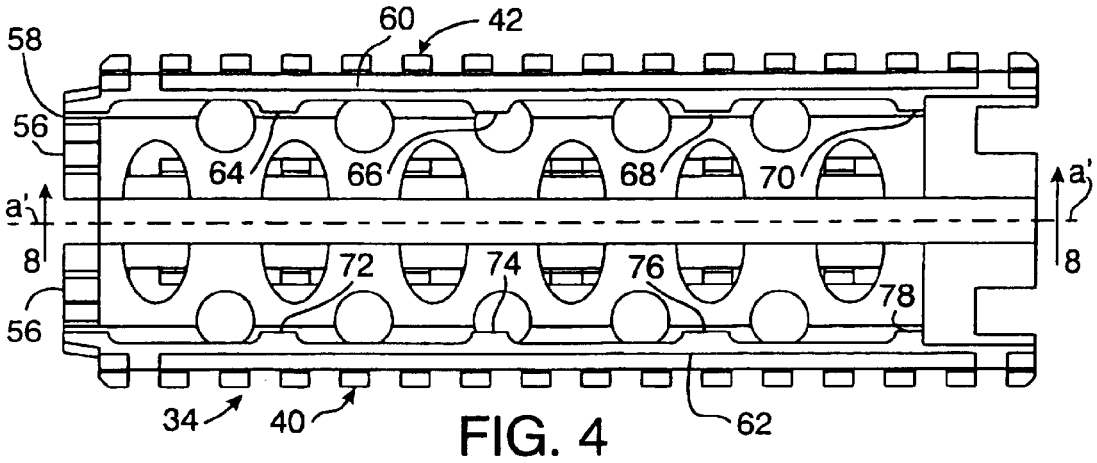
FIG. 4 is a top plan view of the lower mount housing of FIG. 3.
Figure 5:
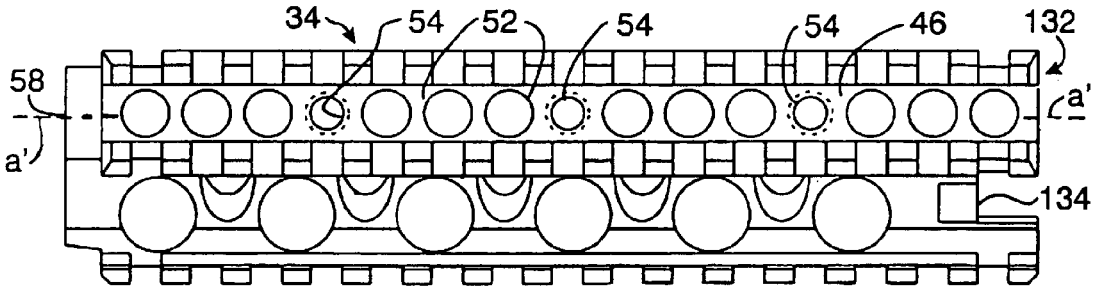
FIG. 5 is a side elevation view of the lower mount housing of FIG. 3.
Figure 6:
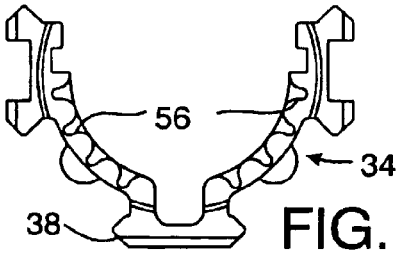
FIG. 6 is a rear elevation view of the lower mount housing of FIG. 3.
Figure 7:
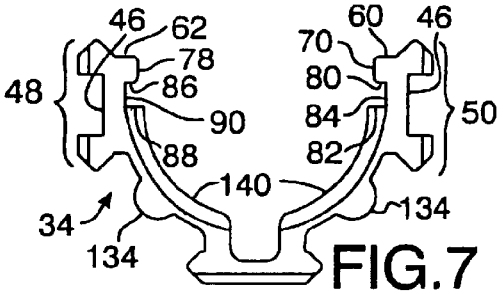
FIG. 7 is a front elevation view of the lower mount housing of FIG. 3.

Rails for accessory mounts are well known in the firearms art, for example as contained in rail interface system devices such as manufactured by Knights Manufacturing Company (of Vero Beach, Fla.), including those disclosed in U.S. Pat. No. 5,826,363 of Douglas D. Olson, as well as those disclosed in U.S. Pat. No. 5,590,484 of Aurelius A. Mooney et al., both of which patents are incorporated herein by reference. One such prior art rail comprises a series of longitudinally spaced-apart ribs 44 (FIG. 3), such as specified in MIL-STD-1913 and commonly known as a Picatinny rail, which is shown in FIGS. 2 and 3 as comprising the bottom rail 38. Such Picatinny rails may be used for the side rail structures 40, 42 as well, which Picatinny rails may be modified by including a slot or channel 46 (see FIGS. 5 and 7) longitudinally extending along the lower mount housing 34 through the ribs 48 and 50, such ribs being oriented perpendicular to the longitudinal axis a'. Either type of rail structure may be utilized for securing accessories having a Weaver style or other cooperating clamping device, although the provision of the channel 46 permits greater adaptability of accessory arrangement on a rail as well as additional types of securement opportunities. Further, the housing wall of each channel 46 may include apertures 52 therethrough, for weight and/or heat reducing purposes, as well as longitudinally spaced-apart apertures 54 preferably with internal threads for the securement of accessories by other securement devices (e.g. screws) instead of or in addition to securement by utilization of the rails 38, 40, 42 alone. Such rail structures 40, 42 are described in U.S. Pat. No. 6,508,027 of Paul Y. Kim, which patent is incorporated herein by reference.

Figure 15:
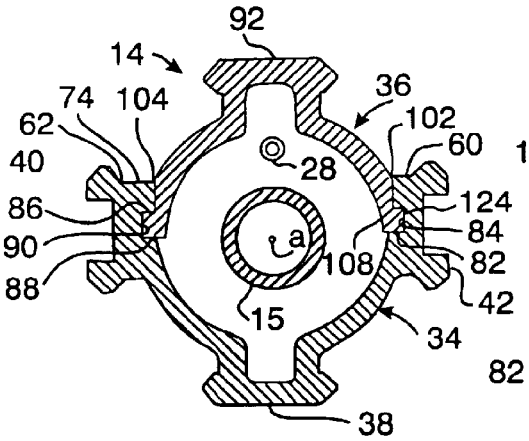
FIG. 15 is a section of the assembled accessory mount of FIG. 14, taken along the line 15—15 of FIG. 14 and viewed in the direction of the appended arrows.

The lower mount housing 34 is adapted to be longitudinally positioned and secured to the firearm 12 laterally about and below the section 15 of the barrel 16 extending substantially from the receiver 20 to the vicinity of the front handguard support cup which in turn is supported at the front sight post 18; i.e., the lower mount 34 is positioned along the barrel 16 such that the barrel section 15 longitudinally extends within the interior of the lower housing 34 as illustrated in FIGS. 2 and 15 (the gas tube 28 not being shown in FIG. 2 for clarity of presentation). The lower mount housing 34 includes a rear end portion 58 having at least one and preferably two rearwardly extending projections such as the arcuate scalloped tabs 56 (see FIGS. 4 and 6) positioned and dimensioned for being inserted into the handguard rear cup 32 along mating scallops of the conventional scalloped barrel nut so as to cause the lower mount housing's rear end 58 to be supported by the receiver 20 when the mount 14 is to be installed on the firearm 12.

The lower mount housing 34 includes two upper longitudinal edges 60, 62 along the respective sides thereof. A plurality of longitudinally spaced-apart first protuberances or lugs, illustrated by the first lugs 64, 66, 68, 70 shown best in FIGS. 4 and 8, transversely project inwardly along the inner surface of the lower mount housing 34 adjacent to the lower housing's first longitudinal edge 60. A plurality of longitudinally spaced-apart second protuberances or lugs 72, 74, 76, 78 (FIG. 4) transversely project inwardly along the inner surface of the lower mount housing 34 adjacent to the lower housing's second longitudinal edge 62.

The bottom surfaces 80 of the first lugs 64, 66, 68, 70 are longitudinally aligned with each other and spaced by a distance h above a series of transverse ledges 82 longitudinally aligned along the inner surface of the lower housing 34, defining a longitudinal channel 84 (FIG. 7) of height h (FIG. 8) in the wall of the lower housing 34 preferably along substantially its entire length. Similarly, the bottom surfaces 86 of the second lugs 72, 74, 76, 78 are longitudinally aligned above a series of transverse ledges 88 (FIG. 7) similar to the transverse ledges 82, along the inner surface of the lower housing 34 to define a longitudinal channel 90 (FIG. 7) of preferably the same height h as the channel 84, in the lower housing wall.

The second or upper mount housing 36 (FIGS. 9–13) extends along a longitudinal axis a", and includes at least one longitudinal rail structure, preferably a top rail structure 92 along the exterior top thereof, which top rail structure 92 may be similar to the bottom rail structure 38 of the lower housing 34, such as comprising a Picatinny rail as previously described.

The upper mount housing 36 is adapted to be longitudinally positioned and secured to the lower mount housing 34, laterally about and above the section 15 of the barrel 16 extending substantially from the vicinity of the receiver 20 to the front support cup 30 when the lower mount 34 is supported by the rear cup 32 at the receiver 20, the upper mount housing 36 being preferably of substantially the same length as the lower mount housing 34. The upper housing 36 includes a rear end portion 94 having at least one and preferably two rearwardly extending projections such as the arcuate tabs 96 insertable into the rear cup 32. The upper housing front end portion 98 includes at least one and preferably two forwardly extending projections such as the forwardly extending tabs 100 for engaging the firearm's front support which, in the case of an M-4 or M-16 automatic rifle, is exemplified by the front cup 30.

The upper mount housing 36 includes two lower longitudinal edges 102, 104 along its respective sides. A plurality of longitudinally spaced-apart first appendages, illustrated by the first appendages 106, 108, 110, 112 (FIG. 13) extend or depend from the upper housing's first lower longitudinal edge 102 in the same manner as does a like plurality of longitudinally spaced-apart second appendages, illustrated by the appendages 114, 116, 118, 120 (FIGS. 9 and 13) extending or depending from the upper housing's second longitudinal edge 104.

Each of the appendages 106–120 comprises a tang 122 (see, for example, FIGS. 9 and 11) extending or depending from its respective longitudinal edge 102 or 104, each tang 122 preferably being arcuate or following the curvature of the semicylindrical upper housing 36. Each tang 122 terminates with an outwardly transverse flange 124 having an upper surface 126 and a lower surface 128. The vertical distance between the upper surface 126 and the lower surface 128 is slightly less than the height h of the longitudinal channel 84 or 90 in the lower mount housing 34, and the dimensions of the upper mount housing 36 are related to the dimensions of the lower mount housing 34 such that the flanges 124 of the first appendages 106–112 slip-fit into and along the lower housing's first longitudinal channel 84 and the flanges 124 of the second appendages 114–120 slip-fit into and along the lower housing's second longitudinal channel 90, when the upper housing 36 is placed to the lower housing 34 with their respective first longitudinal edges 60 and 102 adjacent to one another and with their respective second longitudinal edges 62 and 104 adjacent to one another, as represented in FIG. 15. When the upper housing 36 is so placed to the lower housing 34, the upper housing's longitudinal axis a" preferably coincides with the lower housing's longitudinal axis a'.

One of the mount housings 34 or 36 is provided with an adjustment device for urging the two housings in longitudinally opposite directions. In the preferred embodiment, the front end portion 98 of the second or upper housing 36 includes at least one and preferably two threaded longitudinal bores 129 therethrough, each longitudinally carrying a set screw 130 (see FIGS. 9 and 12). The forward end portion 132 of the lower mount housing 34 includes two forwardly-facing transverse bearing surfaces 134 (see FIGS. 3, 5, 7 and 14) longitudinally aligned with the respective threaded bores 129 of the upper mount housing forward end 98 such that the tail ends 136 of the set screws 130 are caused to bear against the respective bearing surfaces 134 when the upper housing 36 is placed to the lower housing 34 and the set screw 130 is caused to be rearwardly displaced or screwed into the bores 129.

When installing the accessory mount 14 on the firearm 12, the user positions the lower mount housing 34 such that its longitudinally extending rear projections or arcuate tabs 56 are inserted in the handguard rear cup 32 at the firearm's receiver 20. The length of each of the arcuate tabs 56 is preferably slightly greater than the longitudinal depth of the rear cup 32, and when positioned as described the lower housing rear end 58 is supported by the outer circumferential wall of the rear support cup 32, as shown in FIG. 2.

The upper mount housing 36 is placed upon the lower mount housing 34, with the upper housing's lower longitudinal edges 102, 104 adjacent to the lower housing's upper longitudinal edges 60, 62, respectively, with the upper housing's rearwardly extending tabs 96 inserted into the rear cup 32 and the upper housing's forwardly extending tabs 100 positioned for being inserted into the front support cup 30.

Figure 8:
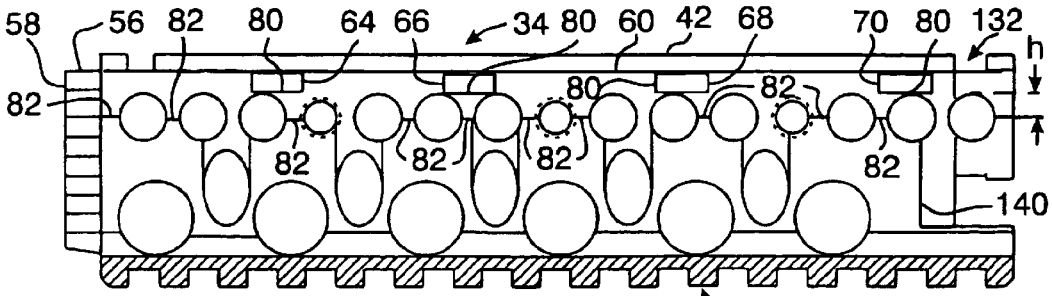
FIG. 8 is a section of the lower mount housing, taken along the line 8—8 of FIG. 4 and viewed in the direction of the appended arrows.
Figure 9:
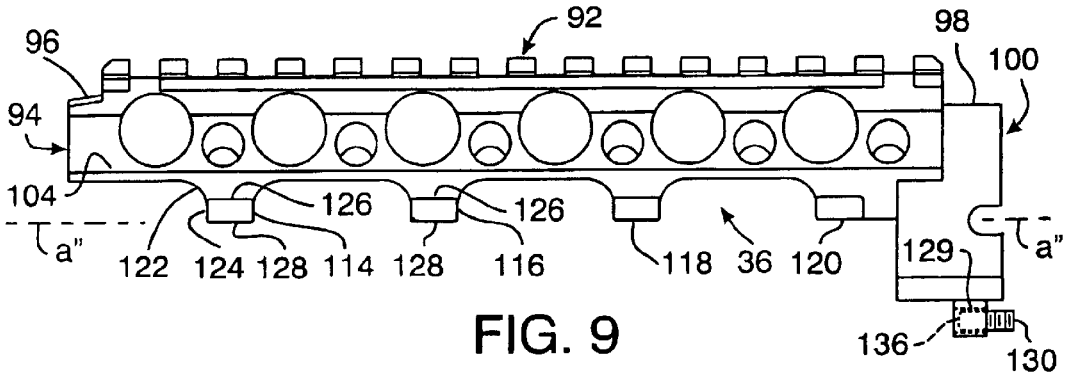
FIG. 9 is a side elevation view of a preferred embodiment of a second or upper mount housing forming a part of the accessory mount embodiment shown in FIG. 2, in increased scale.
Figure 10:
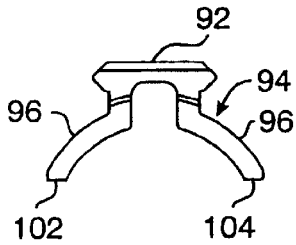
FIG. 10 is an elevation view of the rear end of the upper mount housing of FIG. 9.
Figure 11:
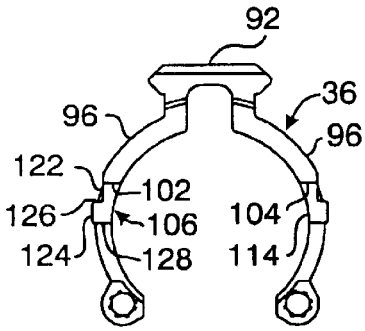
FIG. 11 is a rear elevation view of the upper mount housing of FIG. 9.
Figure 12:
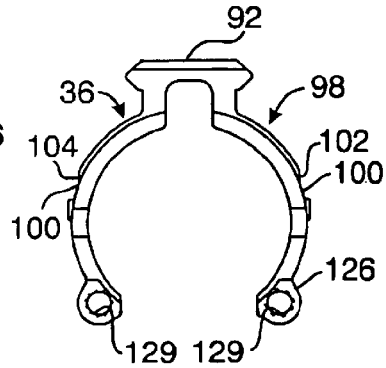
FIG. 12 is a front elevation view of the upper mount housing of FIG. 9.
Figure 13:
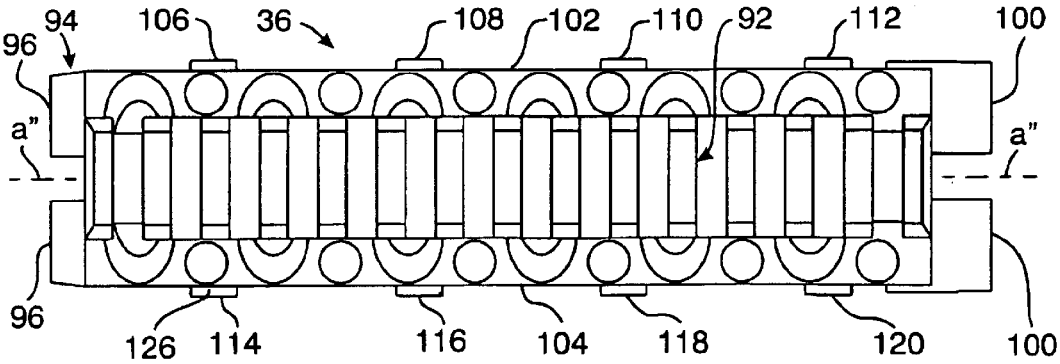
FIG. 13 is a top plan view of the upper mount housing of FIG. 9.

As previously indicated, the opposed transverse walls of each of the longitudinal channels 84, 90 of the lower housing 34 are discontinuous, comprising the longitudinally aligned spaced-apart respective bottom surfaces of the lugs 80, 86 and the ledge segments 82, 88, as shown in FIG. 8. The length of each of the first and second lugs 64–78 and of the flanges 124, and their longitudinal spacing along the lower and upper housings, are such that the flanges 124 of the first and second appendages 102–120 may be directed into their respective channels 84, 90 by the flanges 124 being passed through discontinuities created by the longitudinal spacing of the lugs when the upper housing 36 is placed to the lower housing 34 during installation.

At this initial installation position, the flange of each of the appendages is positioned in its appropriate channel 84 or 90 and just rearwardly of its corresponding lug. At this point, the user adjusts the setscrews 130 for causing their tail ends 136 to contact the lower housing's bearing surfaces 134. Continued screwing of the set screws 130 through the threaded bores 129 urges the lower housing 34 and the upper housing 36 in opposite directions, the upper housing 36 longitudinally moving in the forward direction relative to the lower housing 34, with the flanges 124 longitudinally sliding along their appropriate channel 84, 90 acting as tracks for the flanges. Such relative movement of the two housings urges the lower housing 34 rearwardly and the upper housing 36 forwardly.

The longitudinal spacing of the lugs and flanges are such that longitudinal forward movement of the upper housing 36 relative to the lower housing 34, from the initial installation position, causes the upper surfaces 126 of each of the flanges 124 of the appendages 106–120 to contact respective bottom surfaces 80, 86 of the lugs 64–78. In addition, the bottom surfaces 128 of the flanges 124 of at least two (and preferably all) of the first appendages 106–112 contact ledges 82 along the first channel 84, and the bottom surfaces 128 of the flanges 124 of at least two (and preferably all) of the second appendages 114–120 contact the ledges 88 along the second channel 90. In such manner, the flanges 124 of the appendages 106–120 are captured between their respective lugs 64–78 and ledges 82, 88 (i.e. within their respective channels 84, 90), preventing transverse movement while permitting longitudinal movement of the upper housing 36 with respect to the lower housing 34.

Figure 14:
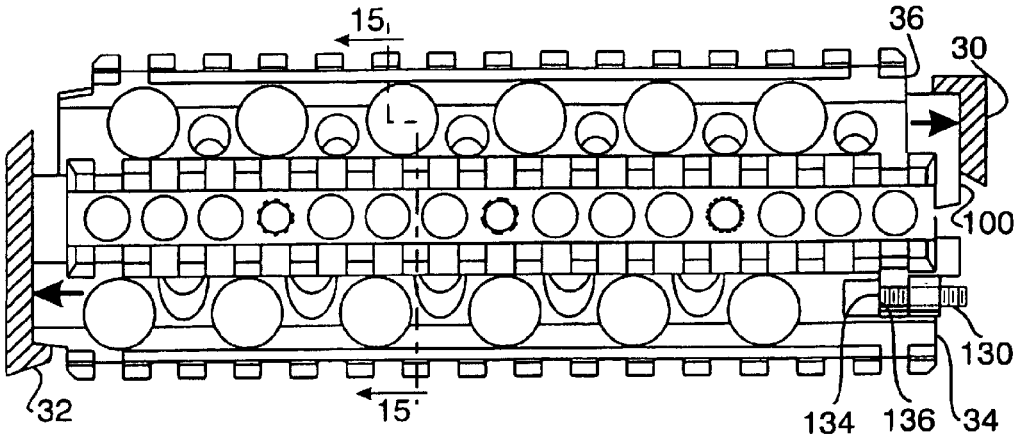
FIG. 14 is a side elevation view of the lower and upper mount housings of FIG. 2 assembled together.

Such longitudinal relative movement of the two housings 34, 36 further urges the rearwardly facing edges of the lower housing's rear tabs 56 against the firearm's rear support cup 32 at the receiver 20 while urging the upper housing's forwardly extending tabs 100 into and against the forward support cup 30, thereby longitudinally clamping the combined upper housing 36 and lower housing 34 (i.e. the accessory mount 14) to and between the firearm's rear support cup 32 at the receiver 20 and the firearm's forward support cup 30. The amount of longitudinal adjustment by the set screws 130 is controlled by the user to produce relative longitudinal movement between the upper housing 36 and the lower housing 34 so as to cause the flanges 124 to be forwardly positioned along their appropriate channels 84, 90 beneath their corresponding lugs, as described above and as exemplified in FIG. 15, causing the upper housing 36 and the lower housing 34 to be transversely secured together. Specifically, the flanges 124 of the first appendages 106, 108, 110, 112 extend into the lower housing's first channel 84 and are situated beneath and contacting the respective first lugs 64, 66, 68, 70, while the flanges 124 of the second appendages 114, 116, 118, 120 extend into the lower housing's second longitudinal channel 90 and are situated beneath and contacting the respective second lugs 72, 74, 76, 78. The accessory mount 14 is installed on the firearm 12 as shown in FIGS. 14 and 15, the longitudinal axes a, a' and a" preferably coinciding with one another.

The accessory mount 14 may be quickly and easily removed from the firearm 12 by reversing the installation procedure, i.e. by the user unscrewing or forwardly adjusting the set screws 130 sufficiently to release the ends 100 and 56 from their pressure contact with the respective handguard front and rear supports 30, 32, and for longitudinally displacing the flanges 124 from the lugs 64–78. The upper housing 36 may then be upwardly removed from the lower housing 34, whereupon the lower housing 34 may be removed from the firearm 12.

The lower housing 34 and the upper housing 36 may be manufactured using fabrication methods well known in the art, of well known of materials typically used in the art of making firearm accessory mounts including metals such as light weight aluminum alloys and other rigid and durable materials such as polymeric materials.

Although the M-4 and M-16 automatic rifles have been exemplified herein, the accessory mount of the invention may be fitted for being installed on other types of firearms.

Although the first housing 34 has been described as a lower housing and the second housing 36 has been described as an upper housing, these housings may be placed laterally along the firearm barrel 16 rather than vertically therealong. Further, the housings 34, 36 may be placed along the firearm barrel 16 such that they are vertically reversed, i.e. the first housing 34 is situated above the second housing 36.

Figure 16:
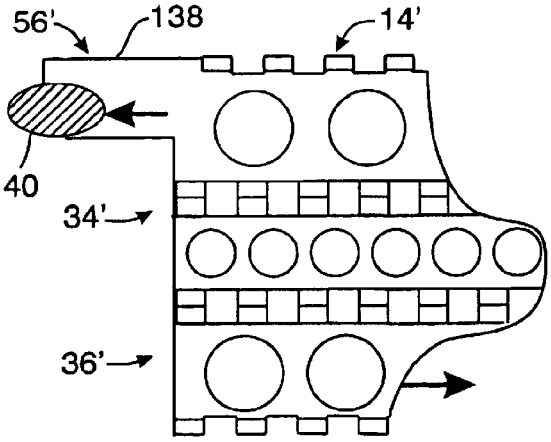
FIG. 16 is a fragment of a second preferred embodiment of an accessory mount according to the aforementioned parent application Ser. No. 10/447,874, adapted for use with another type of firearm.

FIG. 16 is a fragment of a rear portion of an accessory mount 14' where the first mount housing 34' is vertically above the second mount housing 36'. In this embodiment, the rear end 56' of the first housing 34' includes rear extensions 138 configured for mating with a horizontal post 140 (shown in cross-section) at the firearm's receiver, for example of the type carried by a Sig Sauer 551 rifle. Such horizontal post 140 at the firearm's receiver provides the rear support for the accessory mount 14', serving the same rear support purpose as does the rear slip ring or cup 32 of the M-4 or M-16 rifles as previously described. When the first mount housing 34' is placed to the rifle barrel with its rear extension upon and supported by the rifle's horizontal post 142, the second mount housing 36' is then placed beneath and to the first housing 34' with their respective lugs and flanges disposed for interacting as previously described. Relative movement of the two housings 34', 36' urges the rear extensions 138 rearwardly against the firearm's horizontal post 140 at the firearm's receiver while urging the second housing's front end portion 98 into and against a front support cup, as indicated by the arrows in FIG. 16.

FIGS. 17–26 are illustrative of preferred embodiments of accessory mount apparatus and methods according to the present invention.

Figure 17:
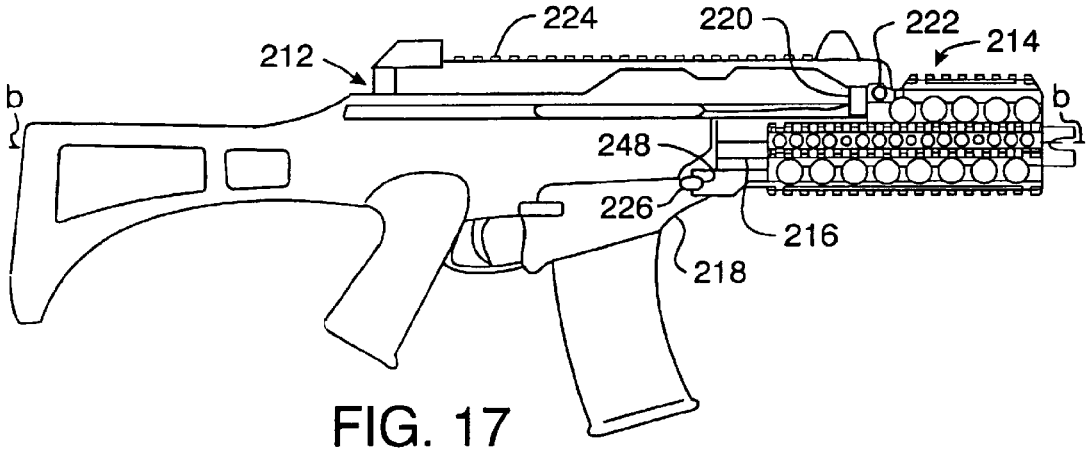
FIG. 17 is a side elevation view of an example of a firearm to which a preferred embodiment of an accessory mount according to the present invention is secured.

Turning to FIG. 17, there is illustrated an example of a firearm 212, specifically a G36 carbine as manufactured by Heckler and Koch, Inc. (of Sterling, Va.), to which a preferred embodiment of an accessory mount 214 according to the present invention is equipped. The accessory mount 214 is secured to the firearm 212 and surrounds a section of the firearm's barrel 216 along the firearm's fore-end section forwardly of the receiver 218.

Consistent with usage as described above, and in particular with respect to FIGS. 17–26, the word "front" or "forward" describes a direction toward the muzzle of the barrel 216 (i.e., to the right as shown in FIG. 17); "rear" or "rearward" describes the direction opposite the front (i.e., to the left as shown in the drawing of FIG. 17); "above" or "upper" means vertically above when the firearm 212 is in a firing position with its barrel 216 horizontal; "below" or "lower" means vertically below when the firearm 212 is in a firing position with its barrel 216 horizontal; "longitudinal" means the direction along or parallel to the longitudinal axis b of the barrel 216 or the longitudinal axes of the accessory mount 214 or mount housings 228 and 230; and "transverse" means a direction perpendicular to a longitudinal direction.

G36 carbines typically include an upwardly projecting lug 220 forwardly of the receiver 218 and above the barrel 216. The lug 220 includes a transverse bore or pair of transversely aligned bores in which a transversely extending pin 222 is disposed for facilitating securement of the front end of the firearm's carrying handle 224. Such firearms further typically include a projection 226 transversely extending from each side of the firearm, below and to the rear or rearwardly of the barrel's connection to the receiver 218. The transverse projections 226 may be provided by a transversely extending post secured to the firearm 212. Such post or transverse projections 226, along with the transverse pin 222, normally function for facilitating securement of a single piece handguard (not shown) usually supplied with a G36 carbine, which handguard has been removed from the firearm for permitting installation of the accessory mount 214 of the present invention.

Considering FIGS. 18–26 as well as FIG. 17, the accessory mount 214 includes a generally semicylindrical first accessory mount shell or housing 228 and a generally semicylindrical second accessory mount shell or housing 230. The term "cylindrical" is used herein in its broad sense as having curved or polygonal surface configurations, as well as combinations thereof; and the term "semicylindrical" is used herein in its broad sense as denoting a partial cylindrical configuration, i.e. the housing 228 or 230 may have a cross-sectional configuration extending through an arc greater or less than 180°, as well as describing an arc of 180°. In the preferred embodiment shown in FIGS. 17–26, the cross-sectional configurations of the first or lower housing 228 (FIG. 22) and the upper housing 230 (FIG. 24) each describe an arc of approximately 180°.

The first or lower mount housing 228 (FIGS. 18–22) extends along a longitudinal axis b', and includes at least one longitudinal rail structure therealong such as a bottom rail structure 232 along the exterior underside thereof, and which may also include side rail structures 234 along the exterior of each side of the lower housing 228, to which may be mounted one or more firearm accessories such as a target illuminator 235 (shown in FIG. 26), a laser sight, a handgrip, and other devices.

Figure 18:
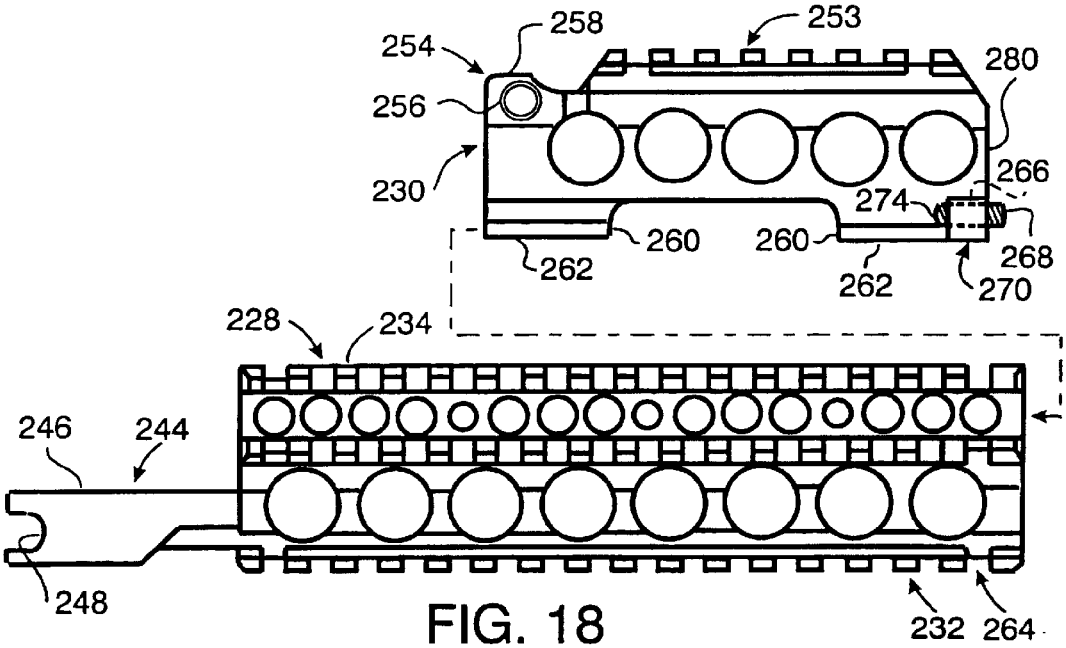
FIG. 18 shows a side elevation view of a first or lower mount housing and a side elevation view of a second or upper mount housing of the preferred embodiment of the accessory mount of FIG. 17, in increased scale, in process of being assembled.
Figure 22:
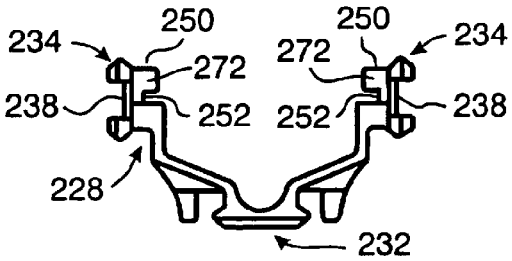
FIG. 22 is a front elevation view of the lower mount housing of FIG. 19.
Figure 19:
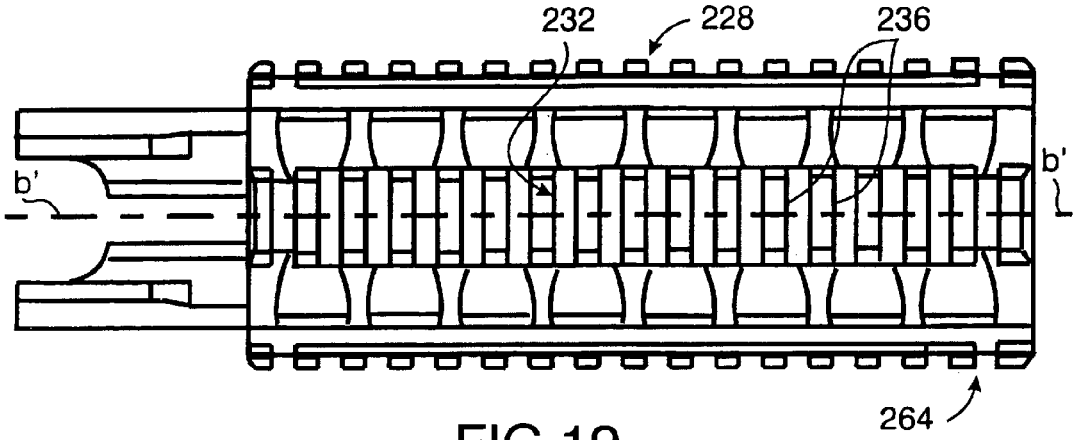
FIG. 19 is a bottom plan view of a preferred embodiment of the first or lower mount housing shown in FIG. 18.
Figure 20:
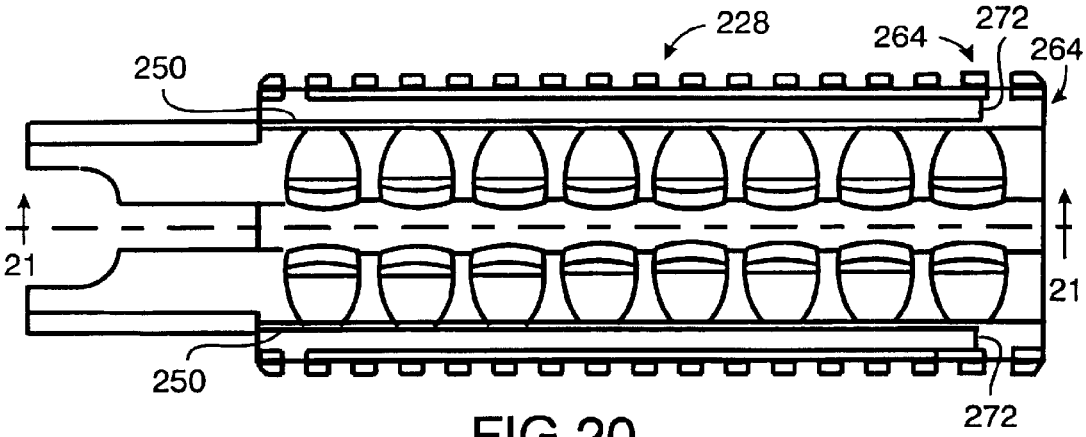
FIG. 20 is a top plan view of the lower mount housing of FIG. 19.

Rails for accessory mounts are well known in the firearms art, as previously discussed herein. One such prior art rail comprises a series of longitudinally spaced-apart ribs 236 (FIG. 19), such as specified in MIL-STD-1913 and commonly known as a Picatinny rail, which is shown in FIGS. 18, 19 and 22 as comprising the bottom rail 232. Such Picatinny rails may be used for the side rail structures 234 as well, which Picatinny rails may be modified by including a slot or channel 238 (see FIG. 22) longitudinally extending along the lower mount housing 228 through the ribs 236, such ribs being oriented perpendicular to the longitudinal axis b'. Either type of rail structure may be utilized for securing accessories having a Weaver style or other cooperating clamping device, although the provision of the channel 238 permits greater adaptability of accessory arrangement on a rail as well as additional types of securement opportunities. Further, the housing wall of each channel 238 may include apertures 240 therethrough (FIG. 21), for weight and/or heat reducing purposes, as well as longitudinally spaced-apart apertures 242 therethrough preferably with internal threads for securement of accessories by other securement devices (e.g. screws) instead of or in addition to securement by utilization of the rails 232, 234 alone. Such rail structures 234 are described in U.S. Pat. No. 6,508,027 of Paul Y. Kim, incorporated herein by reference.

Figure 21:
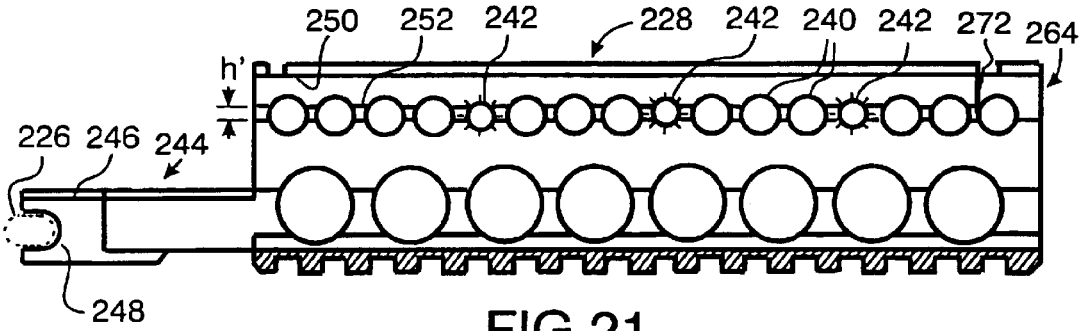
FIG. 21 is a cross-section of the lower mount housing, taken along the line 21—21 of FIG. 20 and viewed in the direction of the appended arrows.
Figure 23:
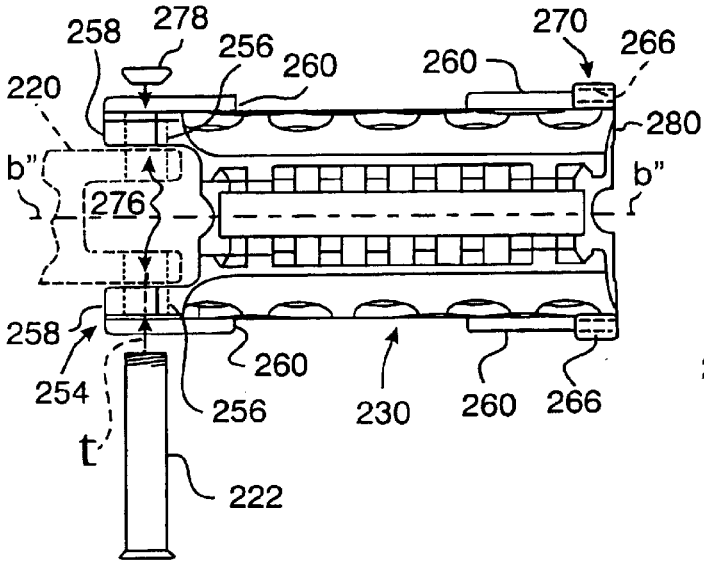
FIG. 23 is a top plan view of a preferred embodiment of the second or upper mount housing shown in FIG. 18, represented in process of being secured to the firearm of FIG. 17.
Figure 24:
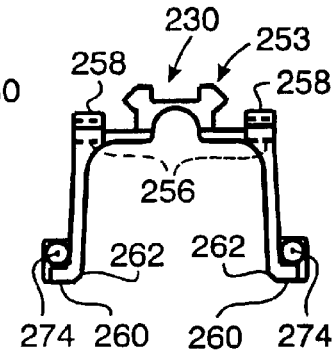
FIG. 24 is a rear elevation view of the upper mount housing of FIG. 23.

The lower mount housing 228 is adapted to be longitudinally positioned and secured to the firearm 212 laterally about and below a section of the barrel 216. The lower mount housing 228 includes a rear end portion 244 comprising, in the example shown, at least one and preferably two rearwardly extending projections 246 each having a rearwardly disposed notch 248 configured for mating with the firearm's transverse projections 226 (FIGS. 17, 18 and 21). The firearm's transverse projections 226 comprise a support for the rear portion 244 of the lower housing 228 when the mount 214 is to be installed on the firearm 212.

The lower mount housing 228 includes two upper longitudinal edges 250 along the respective sides thereof. Longitudinal channels 252 of height h' (FIGS. 21 and 22) are disposed in the inner wall of the lower housing 228, adjacent to and preferably along substantially the entire length of the upper housing's longitudinal edges 250 respectively.

The second or upper mount housing 230 (FIGS. 18, 23 and 24) extends along a longitudinal axis b", and includes at least one longitudinal rail structure, preferably a top rail structure 253 along the exterior top thereof, which top rail structure 253 may be similar to the bottom rail structure 232 or the side rail structure 234 of the lower housing 228, such as comprising a Picatinny rail or modified Picatinny rail as previously described.

The second or upper mount housing 230 is adapted to be longitudinally positioned and secured to the first or lower mount housing 228, laterally about and above a section of the firearm's barrel 216. The upper housing 230 includes a rear portion 254 having at least one and preferably two openings or apertures 256 (FIGS. 18, 23 and 24) transversely aligned through respective ears 258 on opposing sides of the upper housing 230. The diameters of the openings or apertures 256 are slightly larger than the diameter of the pin 222 (normally supplied with the firearm), and are transversely aligned for receiving the pin 222.

Figure 25:
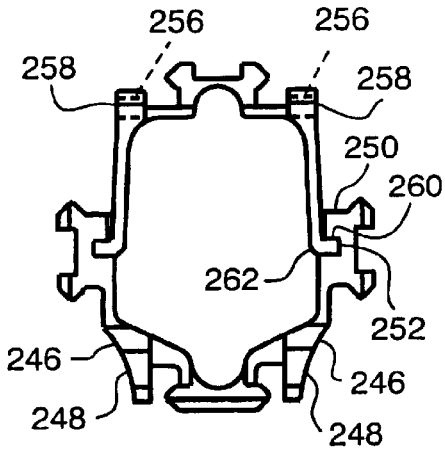
FIG. 25 is a rear elevation view of the assembled lower and upper mount housings of FIG. 18.

The upper mount housing 230 includes outwardly transverse tongues or flanges 260 longitudinally disposed along the sides of the upper housing, preferably extending along the upper housing's lower longitudinal edges 262 (FIGS. 18, 23 and 24) along each side of the upper housing 230. The height of the flanges 260 is slightly less than the height h' of the longitudinal channels 252 in the lower mount housing 228, and the dimensions of the upper mount housing 230 are related to the dimensions of the lower mount housing 228 such that the flanges 260 slip-fit into and are slidable along the lower housing's channels 252, when the upper housing 230 is placed to the lower housing 228 with the upper housing's rear portion 254 engaging the lower housing's front portion 264 as represented in FIG. 18. As the upper housing's flanges 260 are slid along the lower housing's channels 252, the respective upper and lower longitudinal edges 262 and 250 are disposed adjacent to one another, as represented in FIG. 25. The upper and lower housings 230, 228 are transversely secured to one another and the upper housing's longitudinal axis b" preferably coincides with the lower housing's longitudinal axis b'.

One of the mount housings 228, 230 is provided with an adjustment device for urging the two housings in longitudinally opposite directions. In the preferred embodiment, the front portion 270 of the upper housing 230 includes at least one and preferably two threaded longitudinal bores 266 therethrough, each longitudinally carrying a set screw 268 (FIG. 17). The front portion 264 of the lower mount housing 228 includes two forwardly facing transverse bearing surfaces 272 (FIGS. 20 and 21) longitudinally aligned with the respective threaded bores 266 of the upper mount housing's front portion 270 such that the tail ends 274 of the set screws 268 are caused to bear against the respective bearing surfaces 272 when the upper housing 230 is slidingly placed to the lower housing 228 such that the set screws' tail ends 274 contact their respective bearing surfaces 272 and the set screws 268 are caused to be rearwardly displaced or screwed into the threaded bores 266.

When installing the accessory mount 214 on the firearm 212, the user positions the lower mount housing 228 along and below the barrel 216 such that the notches 248 of its lower housing's rearwardly extending projections 246 receivably engage the firearm's transverse projections 226 (represented in phantom in FIG. 21), the firearm's transverse projections 226 thereby supporting the rear portion 244 of the lower housing 228.

The upper mount housing 230 may then be placed to the lower mount housing 228 with the upper housing's longitudinal flanges 260 slidably received by the lower housing's longitudinal channels 252, the upper housing 230 having been placed to the lower housing 228 with the upper housing's rear portion 254 engaging the lower housing's front portion 264. The upper housing 230 is thereupon rearwardly slid along the lower housing 228, the upper housing 230 positioned along and above the barrel 216, until the upper housing's transverse openings or apertures 256 are transversely aligned with transverse bores 276 in the firearm's lug 220 (shown in phantom in FIG. 23) situated forwardly of the receiver 218 and above the barrel 216, the upper housing's rear portion 254 being positioned such that its ears 258 straddle the lug 220. At this point, the user inserts the headed pin 222 into the transversely aligned apertures 256 and bores 276, securing the pin 222 to the upper housing 230 and the lug 220 such as by means of a threaded nut or cap 278 threadedly engaging the threaded end of the pin 222. The pin 222 and its securement to the firearm lug 220 along transverse axis t comprise a firearm support for the upper housing 230, pivotally securing the rear portion 254 of the upper housing 230 to the pin 222 and about transverse axis t. Such firearm second support 220/222 is situated above the barrel 216 and forwardly of the firearm's first support (e.g., the lateral transverse projections 226) and rearwardly of the front end 280 of the installed upper housing 230, preferably at the upper housing's rear portion 254.

It may be appreciated that the upper housing 230 may be placed to the lower housing 228 with the flanges 260 slidably received by the channels 254, before the lower housing is positioned for being supported by the first support or transverse projections 226. In such event, the assembled lower and upper housings 228, 230 would be positioned along and about the barrel 216 with the lower housing's rear portion 244 being supported by the first support or transverse projections 226 and with the upper housing's rear portion 254 placed for being supported by the second support or pin 222.

In either case, after the upper housing 230 has been pivotally secured about the pin 222, the user rearwardly adjusts the setscrews 268 for causing their tail ends 274 to contact the lower housing's bearing surfaces 272. Continued rearward adjustment or screwing of the setscrews 268 through the threaded bores 266 urges the lower housing 228 and the upper housing 230 in longitudinally opposite directions, the lower housing 228 being urged in the rearward direction and the upper housing 230 being urged in the forward direction. Accordingly, the rear portion 244 of the lower housing 228 is rearwardly urged against the firearm's first support or transverse projections 226, while the rear portion 254 of the upper housing 230 is forwardly urged against the firearm's second support or secured pin 222, thereby longitudinally clamping the combined upper housing 230 and lower housing 228 (i.e. the accessory mount 214) to and between the firearm's first support at the receiver 218 and the second support 222 situated forwardly of the firearm's first support 226 but rearwardly of the upper housing's front end 280 and preferably at the upper housing's rear portion 254.

Figure 26:
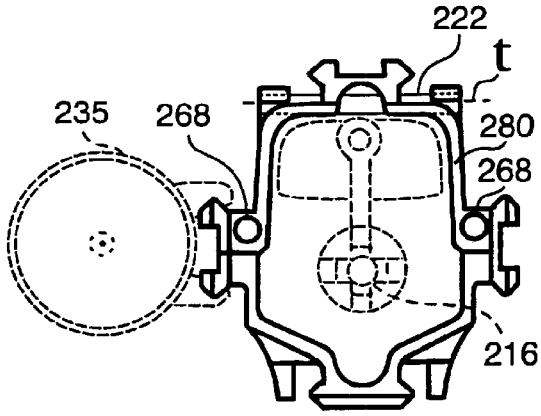
FIG. 26 is a front elevation view of the assembled lower and upper mount housings of FIG. 25, as secured to the firearm and illustrating a firearm accessory secured to the mount assembly.

When the accessory mount 214 is installed on the firearm 212 as shown in FIGS. 17 and 26, the longitudinal axes b, b' and b" are parallel to each other disposed in a vertical plane, and the longitudinal axes b' and b" preferably coincide with one another.

The accessory mount 214 may be quickly and easily removed from the firearm 212 by reversing the installation procedure, i.e. by the user unscrewing or forwardly adjusting the setscrews 268 sufficiently to release the lower and upper housings' rear portions 244, 254 from their pressure contact with the respective firearm first and second supports 226, 222, and by removing the pin 222 from the upper housing's transversely aligned openings or apertures 256. The lower and upper housings may thereupon be forwardly removed from the firearm 212.

The lower housing 228 and the upper housing 230 may be manufactured using fabrication methods well known in the art, of well known materials typically used in the art of making firearm accessory mounts including metals such as lightweight aluminum alloys and other rigid and durable materials such as polymeric materials.

Although the G36 carbine has been exemplified herein, the accessory mount of the present invention may be fitted for being installed on other types of firearms.

Although the first housing 228 has been described as a lower housing and the second housing 230 has been described as an upper housing, these housings may be placed laterally along a firearm barrel rather than vertically therealong. Further, the housings may be placed along a firearm barrel such that they are vertically reversed, i.e. the first housing 228 may be situated above the second housing 230.

Thus, there have been described preferred embodiments of an accessory mount that may be easily, quickly and firmly secured to a firearm, and quickly and easily removed from the firearm, as well as preferred methods of installing the accessory mount on the firearm. Other embodiments of the present invention, and variations of the embodiments presented herein, may be developed without departing from the essential characteristics thereof. Accordingly, the invention should be limited only by the scope of the claims listed below.

We claim:

1. An accessory mount for a firearm having a longitudinal barrel, a first support and a second support forwardly of said first support, the accessory mount comprising the combination of:

a first longitudinal mount housing having a rear portion, said first housing positionable along the barrel with said rear portion of said first housing supported by the first support;

a second longitudinal mount housing having a rear portion, said second housing positionable along the barrel with said rear portion of said second housing supported by the second support;

longitudinal grooves in one of said first and second housings, and longitudinal flanges on the other of said first and second housings slidably received by said channels and transversely securing said first and second housings together; and at least one adjustable member carried by one of said first and second housings and cooperating with the other of said first and second housings for urging said first and second housings in longitudinally opposite directions.

2. The accessory mount according to claim 1, wherein:

said at least one adjustable member rearwardly urges said rear portion of said first housing against said first support and forwardly urges said rear portion of said second housing against said second support.

3. The accessory mount according to claim 1, the second support of the firearm including a transverse pin secured to the firearm above the barrel, wherein:

said rear portion of said second housing includes at least one transverse opening for cooperating with the pin to support said rear portion of said second housing.

4. The accessory mount according to claim 1, the second support of the firearm including a transverse pin removably secured to the firearm above the barrel, wherein:

said rear portion of said second housing includes at least one transverse aperture through which the pin is receivable for supporting said rear portion of said second housing.

5. The accessory mount according to claim 1, wherein:

said first housing includes a front portion and said second housing includes a front portion; and said at least one adjustable member is carried by said front portion of said second housing for cooperating with said front portion of said first housing to rearwardly urge said rear portion of said first housing against said first support and to forwardly urge said rear portion of said second housing against said second support.

6. The accessory mount according to claim 1, wherein:

at least one of said first and second housings includes a rail structure for mounting a firearm accessory thereto.

7. An accessory mount for a firearm having a longitudinal barrel, a first support and a second support forwardly of said first support, the accessory mount comprising the combination of:

a first longitudinal mount housing having a rear portion, said first housing positionable along the barrel with said rear portion of said first housing supported by the first support;

a second longitudinal mount housing having a front end, said second housing positionable along the barrel for being supported by the second support rearwardly of said front end;

longitudinal grooves in one of said first and second housings, and longitudinal flanges on the other of said first and second housings slidably received by said channels and transversely securing said first and second housings together; and at least one adjustable member carried by one of said first and second housings and cooperating with the other of said first and second housings for urging said first and second housings in longitudinally opposite directions.

8. The accessory mount according to claim 7, the second support of the firearm including a transverse pin secured to the firearm, wherein:

said second housing includes at least one transverse opening for cooperating with the pin to support said second housing.

9. The accessory mount according to claim 7, the second support of the firearm comprising a transverse pin removably secured to the firearm, wherein:

said second housing includes at least one transverse aperture through which the pin is receivable for pivotally supporting said second housing.

10. The accessory mount according to claim 7, wherein:

said second housing includes a rear portion for being supported by the second support when said second housing is positioned along the barrel.

11. The accessory mount according to claim 10, wherein:

said at least one adjustable member rearwardly urges said rear portion of said first housing against said first support and forwardly urges said rear portion of said second housing against said second support.

12. The accessory mount according to claim 7, wherein:

at least one of said first and second housings includes a rail structure for mounting a firearm accessory thereto.

13. An accessory mount for a firearm having a longitudinal barrel, a first support and a second support forwardly of the first support and above the barrel, the accessory mount comprising the combination of:

a first semicylindrical mount housing having a rear portion, two longitudinal edges, and longitudinal channels adjacent to said edges respectively, said first housing positionable along the barrel with said rear portion of said first housing supported by the first support;

a second semicylindrical mount housing having a rear portion and longitudinal flanges, said flanges slidably received by said channels, said second housing positionable along said barrel for securing said rear portion of said second housing to the second support; and at least one longitudinally adjustable member carried by one of said first housing and said second housing for urging said first housing and said second housing in longitudinally opposite directions.

14. The accessory mount according to claim 13, wherein:

said at least one adjustable member rearwardly urges said rear portion of said first housing against said first support and forwardly urges said rear portion of said second housing against said second support.

15. The accessory mount according to claim 13, wherein:

said first housing includes a front portion and said second housing includes a front portion; and said at least one longitudinally adjustable member is carried by said front portion of said second housing for cooperating with said front portion of said first housing for rearwardly urging said rear portion of said first housing against the first support and forwardly urging said rear portion of said second housing against said second support.

16. The accessory mount according to claim 13, wherein:

at least one of said first housing and said second housing includes a rail structure for mounting a firearm accessory thereto.

17. Firearm and accessory mount apparatus, comprising in combination:

a firearm including a longitudinal barrel, a first support and a second support forwardly of said first support;

a first longitudinal mount housing having a rear portion, said first housing positioned along said barrel with said rear portion of said first housing supported by said rear support;

a second longitudinal mount housing having a rear portion, said second housing positioned along the barrel with said rear portion of said second housing supported by said second support;

longitudinal channels in one of said first and second housings, and longitudinal flanges on the other of said first and second housings slidably received by said channels and transversely securing said first and second housings together; and at least one adjustable member carried by one of said first and second housings and cooperating with the other of said first and second housings for urging said first and second housings in longitudinally opposite directions.

18. The apparatus according to claim 17, wherein:

said rear portion of said second housing is pivotally secured to said second support about a transverse axis.

19. The apparatus according to claim 17, wherein:

said at least one adjustable member longitudinally urges said rear portion of said first housing against said first support and longitudinally urges said rear portion of said second housing against said second support.

20. The apparatus according to claim 17, wherein:

said second support of said firearm is situated above said barrel.

21. The apparatus according to claim 17, wherein:

at least one of said first and second housings includes a rail structure for mounting a firearm accessory thereto.

22. Firearm and accessory mount apparatus, comprising in combination:

a firearm including a longitudinal barrel, a first support and a second support forwardly of said first support;

a first longitudinal mount housing having a rear portion, said first housing positioned along said barrel with said rear portion of said first housing supported by said rear support;

a second longitudinal mount housing having a front end, said second housing positioned along the barrel and supported by said second support rearwardly of said front end;

longitudinal channels in one of said first and second housings, and longitudinal flanges on the other of said first and second housings slidably received by said channels and transversely securing said first and second housings together; and at least one adjustable member carried by one of said first and second housings and cooperating with the other of said first and second housings for urging said first and second housings in longitudinally opposite directions.

23. The apparatus according to claim 22, wherein:

said second housing is pivotally supported by said second support about a transverse axis.

24. The apparatus according to claim 23, wherein:

said at least one adjustable member rearwardly urges said first housing against said first support and forwardly urges said second housing against said second support.

25. The apparatus according to claim 22, wherein:

said second support of said firearm is situated above said barrel.

26. The apparatus according to claim 22, wherein:

said second housing includes a rear portion supported by said second support.

27. The apparatus according to claim 26, wherein:

said at least one adjustable member longitudinally urges said rear portion of said first housing against said first support and longitudinally urges said rear portion of said second housing against said second support.

28. The apparatus according to claim 22, wherein:

at least one of said first and second housings includes a rail structure for mounting a firearm accessory thereto.

29. A method of installing an accessory mount to a firearm, comprising the steps of:

providing a firearm having a longitudinal barrel, a first support and a second support forwardly of said first support;

providing a first longitudinal mount housing having a rear portion and a second longitudinal mount housing having a rear portion, one of said first and second housings including longitudinal channels and the other of said first and second housings including longitudinal flanges;

positioning said first housing along said barrel with said rear portion of said first housing supported by said first support;

placing said second housing to said first housing with said flanges slidably received by said channels and with said rear portion of said second housing supported by said second support; and urging said first and second housings in longitudinally opposite directions.

30. The method according to claim 29, wherein:

during the firearm providing step, said second support is situated above said barrel.

31. The method according to claim 30, wherein:

during the urging step, rearwardly urging said rear portion of said first housing against said first support and forwardly urging said rear portion of said second housing against said second support.

32. The method according to claim 29, wherein:

during the placing step, pivotally securing said rear portion of said second housing to said second support.

33. The method according to claim 29, wherein:

during the urging step, rearwardly urging said rear portion of said first housing against said first support.

34. The method according to claim 29, wherein:

during the urging step, rearwardly urging said rear portion of said second housing against said second support.

35. A method of installing an accessory mount to a firearm, comprising the steps of:

providing a firearm having a longitudinal barrel, a first support and a second support forwardly of said first support;

providing a first mount housing having a rear portion and a second mount housing having a front end, one of said first and second housings including longitudinal channels and the other of said first and second housings including longitudinal flanges;

positioning said first housing along said barrel with said rear portion of said first housing supported by said first support;

placing said second housing to said first housing with said flanges slidably received by said channels and with said second housing supported by said second support rearwardly of said front end; and urging said first and second housings in longitudinally opposite directions.

36. The method according to claim 35, wherein:

during the firearm providing step, said second support is situated above said barrel.

37. The method according to claim 35, wherein:

during the urging step, said first housing is rearwardly urged against said first support and said second housing is forwardly urged against said second support.

38. A method of installing an accessory mount to a firearm, comprising the steps of:

providing a firearm having a longitudinal barrel, a first support and a second support forwardly of said first support;

providing a first longitudinal mount housing having a rear portion and a second longitudinal mount housing having a rear portion, one of said first and second housings including longitudinal channels and the other of said first and second housings including longitudinal flanges;

placing said second housing to said first housing with said flanges slidably received by said channels;

positioning said first and second housings along said barrel with said rear portion of said first housing supported by said first support and with said rear portion of said second housing supported by said second support; and urging said first and second housings in longitudinally opposite directions.

39. The method according to claim 38, wherein:

during the firearm providing step, said second support is situated above said barrel.

40. The method according to claim 39, wherein:

during the urging step, rearwardly urging said rear portion of said first housing against said first support and forwardly urging said rear portion of said second housing against said second support.

41. The method according to claim 38, wherein:

during the placing step, pivotally securing said rear portion of said second housing to said second support.

42. The method according to claim 38, wherein:

during the urging step, rearwardly urging said rear portion of said first housing against said first support.

43. The method according to claim 38, wherein:

during the urging step, rearwardly urging said rear portion of said second housing against said second support.

44. A method of installing an accessory mount to a firearm, comprising the steps of:

providing a firearm having a longitudinal barrel, a first support and a second support forwardly of said first support;

providing a first mount housing having a rear portion and a second mount housing having a front end, one of said first and second housings including longitudinal channels and the other of said first and second housings including longitudinal flanges;

placing said second housing to said first housing with said flanges slidably received by said channels;

positioning said first and second housings along said barrel with said rear portion of said first housing supported by said first support and with said second housing supported by said second support rearwardly of said front end; and urging said first and second housings in longitudinally opposite directions.

45. The method according to claim 44, wherein:

during the firearm providing step, said second support is situated above said barrel.

46. The method according to claim 44, wherein:

during the urging step, said first housing is rearwardly urged against said first support and said second housing is forwardly urged against said second support.

* * * * *